United States Patent [19]

Barsted

[11] 4,406,354

[45] Sep. 27, 1983

[54] BRAKE EQUIPMENT FOR UNDERGROUND MINING MACHINES

[75] Inventor: Roger Barsted, Burton-on-Trent, England

[73] Assignee: Coal Industry (Patents) Ltd., London, England

[21] Appl. No.: 285,691

[22] Filed: Jul. 21, 1981

[30] Foreign Application Priority Data

Aug. 15, 1980 [GB] United Kingdom ..... 8026658

[51] Int. Cl.[3] ..... B61H 7/12; B60K 41/20; E21C 29/20

[52] U.S. Cl. ..... 192/3 N; 91/45; 188/44; 188/151 A; 188/170; 299/1

[58] Field of Search ..... 91/44, 45; 188/41, 43, 188/44, 151 A, 170, 127; 192/3 N; 299/1; 303/2, 3, 6 M, 10, 71

[56] References Cited

U.S. PATENT DOCUMENTS

| | | | |
|---|---|---|---|
| 4,014,413 | 3/1977 | Monks | 188/170 |
| 4,045,083 | 8/1977 | Monks | 299/1 |
| 4,076,323 | 2/1978 | Kroth | 303/10 |
| 4,097,091 | 6/1978 | Knorr | 299/1 |
| 4,196,798 | 4/1980 | Barsted | 188/44 |
| 4,244,276 | 1/1981 | Iwata | 91/45 |
| 4,254,845 | 3/1981 | Braun | 188/170 |
| 4,307,916 | 12/1981 | Straut et al. | 303/71 |
| 4,313,643 | 2/1982 | Exley | 303/2 |
| 4,322,113 | 3/1982 | Taylor et al. | 299/1 |

FOREIGN PATENT DOCUMENTS

| | | | |
|---|---|---|---|
| 1486978 | 9/1977 | United Kingdom | 299/1 |
| 2000562 | 1/1979 | United Kingdom . | |

*Primary Examiner*—Douglas C. Butler
*Assistant Examiner*—R. R. Diefendorf
*Attorney, Agent, or Firm*—James Creighton Wray

[57] ABSTRACT

Brake equipment for an underground mining machine, which in use traverses to and fro adjacent to a stationary rail extending along a longwall face and which includes a hydraulic haulage drive motor for hauling the machine along the longwall face, is activated to engage the stationary rail if other than a normal haulage condition of the drive motor is sensed, a control for the drive motor being moved into a neutral, machine non-traversing mode when the brake is applied.

3 Claims, 1 Drawing Figure

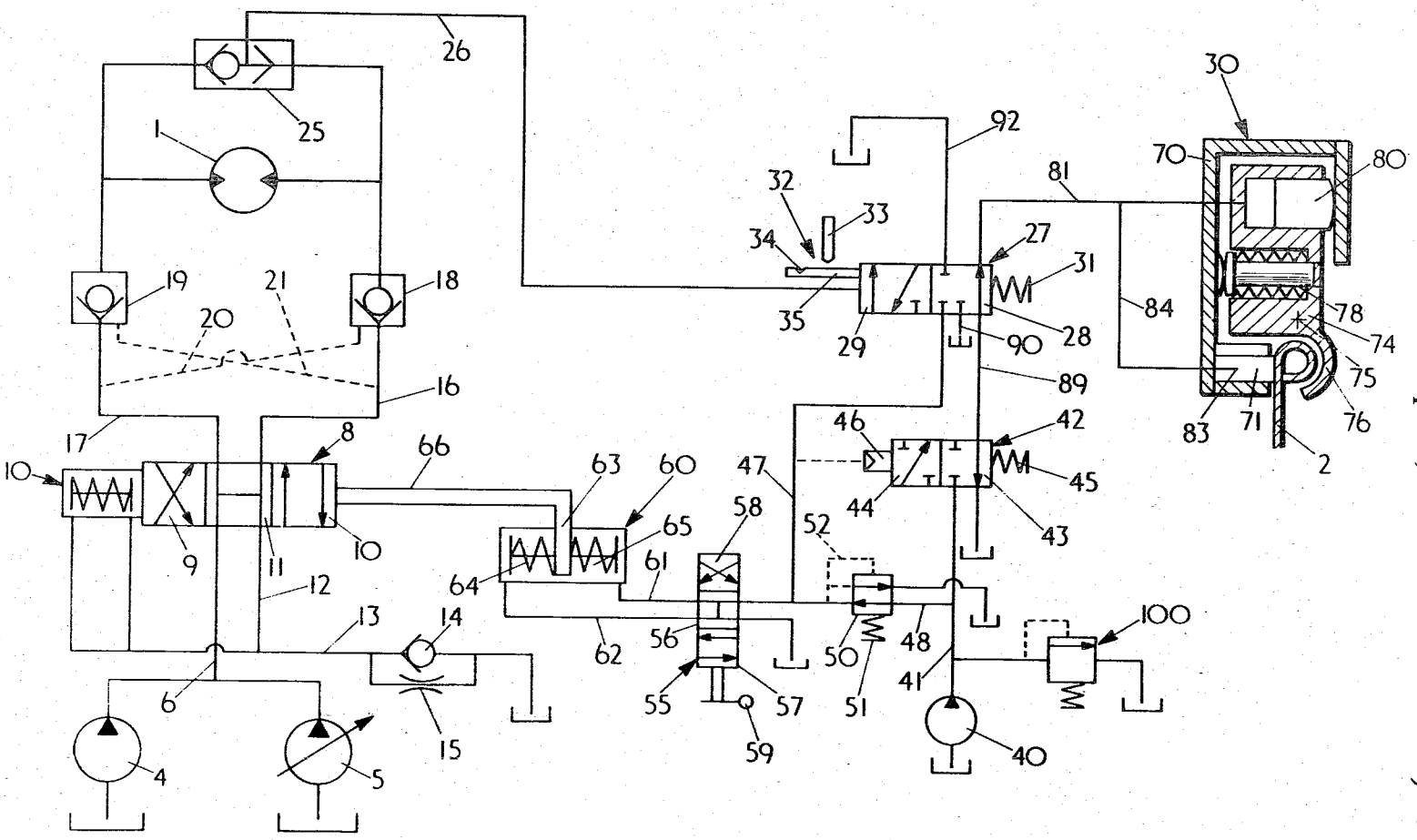
80
74
75
76
78
2
30
71
83
70
84
100
81
31
28
89
42
45
43
27
90
92
40
48
41
33
29
46
44
51
50
52
32
34
35
47
57
59
58
60
65
61
56
55
63
62
64
26
18
16
66
14
15
25
10
8
13
5
21
11
12
20
9
6
1
19
17
4
10

BRAKE EQUIPMENT FOR UNDERGROUND MINING MACHINES

This invention relates to brake equipment for underground mining machines and in particular to machines which have rotary cutters and which, in use, traverse to and fro along longwall faces.

In particular, although not exclusively, this invention relates to a mineral mining machine having a rotary cutter mounted on a ranging arm and rotatable about an axis transverse to the direction of travel of the machine. With such a known machine it is possible for a machine operator to place the machine's haulage into its neutral mode whilst ranging the arm to change the cutting horizon of the rotating cutter within the mineral seam. Unfortunately, with the machine's haulage in its neutral mode it is possible for the rotating cutter to react aginst relatively hard rock and act as a drive mechanism to propel the machine along the face at dangerously high speed.

In addition, when the machine's haulage is in a driving mode it is possible for the propelling action of the rotating cutter to override the controlled haulage drive so that the machine is propelled along at an uncontrolled and dangerously high speed.

Another problem with the present mining machines is that they can be propelled along under the action of scraper chain coveyors which extend along the longwall face and upon which the machines are mounted.

An object of the present invention is to provide brake equipment for underground mining machines which tend to overcome or reduce the above mentioned problems.

According to one concept of the present invention, brake equipment for an underground mining machine, which in operation traverses to and fro adjacent to a stationary track extending along a longwall face and which includes a hydraulic haulage drive motor, comprises control means arrangeable to sense the operational condition of the haulage drive motor, and a brake securable to the machine, in use, the brake being adapted to engage the stationary track in the "brake applied" mode to retard movement of the machine in at least one direction of machine traverse, the control means being adapted to cause the brake to be applied when the control means senses other than a normal haulage condition of the haulage drive motor, the control means comprising a machine traversing control valve, a flow control valve for controlling supply of pressure fluid to the hydraulic haulage drive motor, and an activator device which in use is activated into a machine traversing mode by operation of the control valve into a machine traversing mode and which, in use is adapted to move the flow control valve into a neutral machine non-traversing mode when the machine traversing control valve is moved into a neutral machine non-traversing mode.

Preferably, the activator device comprises a double acting piston and cylinder device.

Advantageously, the activator device is resiliently biassed towards a neutral machine non-traversing mode.

Preferably, when the flow control valve is in its neutral machine non-traversing mode the pressure fluid supply is exhausted from the haulage drive motor.

Preferably, the control means comprises a shuttle valve arrangeable to sense the pressure of the fluid supply to the haulage drive motor.

Preferably, the shuttle valve is adapted to feed the pressure of the fluid supply to the haulage drive motor to a pilot operated valve adapted to control the supply of pressure fluid to the brake.

Preferably, the pilot operated valve is resiliently biassed against the action of the pressure feed from the fluid supply to the haulage drive motor.

Preferably, the pilot operated valve comprises detent means for retaining the valve in a "brake applied" mode until the valve is manually reset.

According to a further concept the present invention provides an underground mining machine which in use traverses to and fro adjacent to a stationary track extending along a longwall face and which comprises a hydraulic haulage drive motor and brake equipment as defined above.

By way of example only, one embodiment of the present invention now will be described with reference to the accompanying drawing which is a hydraulic circuit diagram of brake equipment constructed in accordance with the present invention.

In the drawing, a hydraulic haulage drive motor 1 of an underground mineral mining machine (only a portion of the haulage drive and brake equipment of which are shown) which in use traverses to and fro adjacent to a stationary track constituted by an upstanding rail 2 fixedly secured to a scraper chain conveyor (not shown) extending along the longwall face and upon which the machine is mounted for guided movement along the longwall face. The machine is provided with mineral cutting means (not shown) comprising a rotary cutter head mounted on a ranging arm pivotally mounted on the machine body, the arm being ranged up or down under the action of a hydraulic ram to vary the cutting horizon of the rotating cutter head within the mineral seam.

The machine's hydraulic haulage drive also comprises a fixed delivery pump 4 and a variable delivery pump 5 mounted in parallel to feed pressure fluid to drive the haulage drive motor 1 via line 6. A three position flow control valve 8 controls the flow of pressure fluid from the pumps 4 and 5 to the haulage drive motor. The flow control valve is shown in a neutral, machine non-traversing mode 11 in which pressure fluid is exhausted from the drive motor and fed via return lines 12 and 13 back to a tank, the return flow being through a non-return valve 14 and restrictor 15 arranged in parallel.

The flow control valve 8 has two alternate operational or machine traversing modes 9 and 10 in which pressure fluid is fed from line 6 to feed lines 16 and 17, respectively, to drive the haulage motor 1 in opposite directions. Thus, the operational setting of the flow control valve 8 determines the direction in which the machine traverses along the longwall face. The feed lines 16 and 17 are provided with pilot operated non-return valves 18 and 19, respectively, which are arranged to sense the pressure of fluid in feed lines 17 and 16, respectively, via pilot lines 20 and 21 such that the check valves 18 and 19 are open only when the sensed fluid pressure in the associated line 17, 16 is above a preselected desired level. Thus, should the pressure in line 16 or 17 fall below the preselected level, the associated check valve will close to prevent further exhaust of fluid from the haulage motor 1.

As seen on the drawing the feed lines 16 and 17 extend beyond the haulage drive motor 1 to a shuttle valve 25 arranged to sense fluid pressure in the feed lines and to feed the higher of the two sensed fluid pressures along line 26 to a spring biassed two position flow control valve 27 having two operational modes 28 and 29 for controlling the feed of pressure fluid to, and the exhaust of pressure fluid from, a hydraulically actuated brake 30 which is explained in more detail later in this specification. The flow control valve 27 is urged into the operational mode 28 (as shown in the drawing) under the action of spring 31 and is urged into the operational mode 29 by the action of the pressure fluid in line 26. The valve is retained in the operational mode 29 by detent means 32 comprising a spring loaded plunger 33 engagable in a recess 34 movable with a spool 35 of the valve. Once the valve 27 is urged into the operational mode 29 it is retained in this mode until it is manually reset by an operator releasing the plunger from the recess.

The brake equipment is fed with relatively high fluid pressure from a pump 40 which feed pressure fluid along line 41 to the valve 27 via a spring biased two position pilot operated valve 42 having operational modes 43 and 44, and biassing spring 45 and a pilot 46 arranged to sense the fluid pressure in line 47 which is fed at reduced pressure from branch line 48 of the line 41. The branch line 48 is provided with a pressure reducing valve arrangement 50 including a biassing spring 51 and pilot lines 52, the arrangement reducing the relatively high pressure fed from pump 40 to the relatively lower operating pressure of the haulage drive system line 47.

Fluid flow along the branch line 48 is controlled by a three position, manually controlled flow control valve 55 having a central neutral, machine non-traversing mode 56 and two alternate operational, machine traversing modes 57 and 58. A control handle 59 is provided enabling the machine operator to select in which direction, if any, the machine is to be traversed along the face. This is achieved by a spring biassed double acting activator device 60 which is fed with activating pressure fluid alternatively via lines 61 or 62 depending upon the operational setting of the valve 55. The activating device comprises a double acting piston 63 which is urged in one direction or the other by the activating pressure fluid against the action of biassing spring means 64, 65 which are arranged to return the activating device 60 to a neutral, machine non-traversing mode upon the valve 55 being activated to its neutral mode 56 in which pressure fluid is exhausted from the activating device. The movable piston 63 of the activating device 60 is drivably connected to the spool of the previously mentioned flow control valve 8 by an link arm arrangement 66 such that in operation the operational setting of the flow control valve 8 is determined by the operational setting of the actuating device 60.

For example, if the directional flow control valve 55 is manually moved into its operational mode 57 by the machine operator, pressure fluid is fed from branch line 48 along line 61 to the righthand side chamber (as seen in the drawings) of the activating device 60 to urge the piston 63 to the left against the action of the biassing spring means 64, 65. This movement of the piston 63 acts via link arm engagement 66 to move the flow control valve 8 into its operational mode 10 in which pressure fluid from pumps 4 and 5 is fed via line 6 to line 17 to drive the haulage motor 1 and the machine is traversed along the longwall face in the desired selected direction. Upon the operator wishing to stop the drive motor, he moves the manually controlled valve 55 into its neutral machine non-traversing mode 56 in which the pressure fluid is exhausted from both sides of the activating device 60 which thereby rapidly returns to its neutral, machine non-traversing mode, the piston 63 acting through the link arm arrangement 66 to move the flow control valve 8 into a neutral, machine non-traversing mode 11. If the machine operator wishes the machine to traverse along the longwall face in the opposite direction, he manually moves the directional control valve 55 into its operational mode 58 in which pressure fluid is fed from the branch line 48 via line 62 to the lefthand chamber (as seen in the drawing) of the activating device 60 so that the piston is moved to the right against the action of the biassing spring means 64, 65. This movement of the piston 63 acts via the link arm arrangement 66 to move the flow control valve 8 into its operation machine traversing mode 9 in which pressure fluid is fed from the pump arrangement 4, 5 via line 16 to drive the haulage drive motor 1 so that the machine is traversed along the face in the opposite direction to that previously discussed. Thus, the machine operator controls the direction of machine traverse by suitably activating the manually operated control valve 55.

The previously mentioned brake 30 is fixedly attached to the mining machine as it traverses to and fro along the longwall face, the brake co-operating with the stationary rail 2 anchored to the conveyor as previously stated.

The brake 30 comprises a casing 70 which bridges the rail 2 and which is provided with brackets (not shown) enabling the brake to be attached to the machine. A part of one side of the casing 70 is provided with an hydraulic wedge arrangement 71 constituting one jaw of a clamp which is adapted to contact the rail 2. The opposite side of the casing is partially closed by a pivotally mounted component 74 arranged to pivot with respect to the remainder of the housing about pivotal mounting 75 and the lowermost margin of which defines one jaw 76 of the clamp. Pivotal movement of the pivotally mounted component 74 is controlled by a spring biassing arrangement 78 tending to pivot the component in a clockwise direction (as seen in the Figure) to urge the jaws 71, 76 of the brake to clamp the rail in a "brake applied" mode, and by an hydraulic piston and cylinder arrangement 80 which when pressurised via line 81 tends to pivot the component 74 against the action of the spring biassing arrangement 78 to release the jaws 71, 76 into a "brake release" mode.

The wedge arrangement 71 comprises two co-operating wedges slidably connected to each other by a retaining slideway. One of the wedge components is fixedly mounted between two blocks secured to the brake casing for general movement in the direction longitudinally of the rails and are provided with stepped bores, respectively. One of the bores contains a hydraulic piston device 83 hydraulically connected to feed line 81 via a branch line 84. The piston device is arranged to abut the movable wedge component which thereby, in operation, is urged down the retaining slideway tending to increase the clamping or braking thrust of the brake. The movable wedge is moved by the action of the piston device 85 to increase the clamping or braking thrust against the action of a spring bias provided in the other of the stepped bores. The spring bias is provided to release the wedge arrangement upon the brake being released. The construction of the brake 30 is shown in more detail in British patent specification No. GB 2 000 562A.

The brake equipment operates in the following manner. With the manually operated control valve 55 in its neutral, machine non-traversing mode 56 fluid is exhausted from the pump 40 via branch line 48 and from the activating device 60 which as previously explained also is its neutral position together with the flow control valve 8 which is linked with the piston 63 of the activating device 60 via the link arm arrangement 66.

The pilot 46 of the valve 42 senses the fluid in line 47 is being exhausted and permits the valve 42 to move under its spring bias 45 into its operational mode 43 thereby connecting line 89 together with line 81 to exhaust. The valve 27 is in the operational mode 28 connecting lines 81 and 89 because the shuttle valve 25 senses the exhaust fluid condition in lines 16 and 17 and thereby connects line 26 to exhaust, the valve 27 to remain in mode 28 under its spring loading. The exhausting of fluid in lines 81 and 84 permits the pivotally mounted component 74 to pivot into a "brakes applied" mode under the action of the spring biassing arrangement 78. Thus, with the machine's haulage system in neutral the brake 30 is in a "brake applied" mode tending to prevent movement of the machine along the face. Thus, with the machine's haulage system in a neutral machine non-traversing mode, the machine operator can range the rotating cutting head to vary the cutting horizon without fear that the reaction between the rotating head and the mineral being cut will cause the machine to move along the face. Further, should a lump of mineral or piece of equipment become jammed between the machine and the running scraper chain conveyor the applied machine brake 30 will prevent undesired movement of the machine.

Upon the machine operator moving the manually operated control valve 55 into one or other of its operational machine traversing modes 57 or 58, pressure fluid from pump 40 is no longer fed to exhaust. Instead pressure fluid is fed along lines 41 and 47 to the flow control valves 42 and 27, respectively. Upon the pilot 46 of valve 42 sensing operating pressure in line 47 the valve 42 is moved against its spring loading into the operational mode 44 in which pressure fluid is fed from line 41 along lines 89 and 81 to the hydraulic piston and cylinder device 80 which thereby urges the pivotally mounted component 74 to pivot in an anticlockwise direction (as seen in the drawing) to release the brake 30 and permit the machine to traverse along the face.

In addition to feeding pressure fluid to release the brake, operation of the valve 55 into one or other of its operational, machine traversing modes, 57 or 58 feeds pressure fluid along line 61 or 62 to activate the activation device 60 which as previously described moves the flow control valve 8 into one or other of its operational, machine traversing modes 9 or 10 in which pressure fluid is fed from the pump arrangement 4, 5 to drive the haulage drive motor 1 thereby traversing the machine along the longwall face in the selected direction.

Upon pressure fluid being fed to drive the haulage motor 1 the shuttle valve 25 senses the driving pressure which is fed along line 26 to the pilot of the valve 27. With normal operational haulage conditions existing the drive pressure in the haulage system i.e., the pressure fed along line 26 is insufficient to move the valve 27 against the action of the preset biassing spring 31. Consequently, during normal operational haulage conditions the valve 27 remains in the operational mode 28 as shown in the drawing such that relatively high pressure fluid from pump 40 is fed along lines 41, 89 and 81 to the brake 30 which thereby, is urged into its "brake release" mode.

If, as the machine is traversing along the longwall face, an event takes place which tends to move the machine at a dangerously high speed, as for example, if the action of the rotating drum tends to drive the machine or if the machine becomes jammed with the conveyor, the haulage motor 1 then will tend to be driven at high speed by the back force of the haulage drive mechanism reacting with the stationary track. The rotating motor tends to function as a pump and induces pressure fluid from line 16 to line 17 (or vice versa depending upon the direction of machine movement). Thus, fluid pressure in line 17 increases. This substantial increase in pressure in line 17 is fed by the shuttle valve 25 along line 26 to the valve 27. Upon the induced pressure reaching a preselected value determined by the setting of the biassing spring 31 the valve 27 is moved against its spring loading into the operational mode 29 in which the fluid in line 81 is exhausted via line 90. As soon as line 81 is connected to exhaust the brake component 74 pivots under the action of the spring arrangement 78 to apply the brake 30 and bring the machine to rest. The valve 27 is retained in the "brake applied" mode 29 until the machine operator checks the haulage system and manually resets the detent means 32.

When the valve 27 is moved into the "brake applied" mode 29, line 47 is connected to exhaust via the valve spool and line 92. As soon as line 47 is exhausted the line 61 or 62 which previously was feeding pressure fluid to the activating device 60 also exhausted to tank and the piston 63 moves under the action of the spring biassing means 64, 65 to its neutral, machine non-traversing mode. As previously explained such a movement of the piston 63 moves the flow valve 8 into a neutral, machine non-traversing mode 11 thereby cutting off the pressure fluid supply to the motor 1, the supply being switched to exhaust via lines 12 and 13.

Thus, it will be appreciated that as soon as the control means for the brake equipment senses that other than a normal haulage condition of the haulage drive motor exists, the control means causes the brake to be applied tending to retard movement of the machine along the face.

The brake equipment also comprises a relief valve 100 arranged to relieve fluid pressure should the pressure exceed a preselected value.

In other embodiments of the invention the stationary rail comprises a series of abutments arranged along the length of said rail and in which case the brake comprises a plunger which in the "brake applied" mode engages at least one of the abutments.

A device 101 is arranged to sense the pressure fed from pumps 4 and 5 and is arranged to move the flow control valve 8 to its neutral, machine non-traversing mode if the sensed pressure falls due to the pumps stopping, for example, due to the removal of the mains supply.

I claim:

1. Brake equipment for an underground mining machine which in operation traverses to and fro adjacent to a stationary track extending along a longwall face and which includes a hydraulic haulage drive motor, comprising control means arrangeable to sense the operational condition of the haulage drive motor, and a brake securable to the machine, in use, the brake being adapted to engage the stationary track in the "brake applied" mode to retard movement of the machine in at least one direction of machine traverse, the control means being adapted to cause the brake to be applied when the control means senses other than normal haulage condition of the haulage drive motor, the control means comprising a machine traversing control valve, a flow control valve for controlling supply of pressure fluid to the hydraulic haulage drive motor such that when the flow control valve is in a neutral machine operating mode, the pressure fluid supply is exhausted from the haulage drive motor, and an activator device which in use is activated into a machine traversing mode by operation of the flow control valve into a machine traversing mode and which, in use, is adapted to move the flow control valve into a neutral machine non-traversing mode when the machine traversing control valve is moved into a neutral machine non-traversing mode, the activator device being resiliently biassed towards a neutral machine non-traversing mode, the control means further comprises a shuttle valve arrangeable to sense the pressure of the fluid supply to the haulage drive motor, the shuttle valve being adapted to feed the pressure of the fluid supply to the haulage drive motor to a pilot operated valve adapted to control the supply of pressure fluid to the brake.

2. Equipment as claimed in claim 1, in which the pilot operated valve is resiliently biassed against the action of the pressure feed from the fluid supply to the haulage drive motor.

3. Equipment as claimed in claim 2, in which the pilot operated valve comprises detent means for retaining the valve in a "brake applied" mode until the valve is manually reset.

* * * * *